US011078430B2

(12) United States Patent
Albe et al.

(10) Patent No.: US 11,078,430 B2
(45) Date of Patent: Aug. 3, 2021

(54) HAZE-FREE BASE OILS WITH HIGH PARAFFINIC CONTENT

(71) Applicant: SHELL OIL COMPANY, Houston, TX (US)

(72) Inventors: Eglantine Armelle Christiane Colette Marie Albe, Rotterdam (NL); Godfried Johannes Aarts, Amsterdam (NL); José Luís Moniz Jardim, Amsterdam (NL); Cornelis Hyacinthus Maria Van Der Hulst, Amsterdam (NL); Ralf Gunnar Meister, Amsterdam (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/471,639

(22) PCT Filed: Dec. 21, 2017

(86) PCT No.: PCT/EP2017/084105
§ 371 (c)(1),
(2) Date: Jun. 20, 2019

(87) PCT Pub. No.: WO2018/115288
PCT Pub. Date: Jun. 28, 2018

(65) Prior Publication Data

US 2020/0087581 A1 Mar. 19, 2020

(30) Foreign Application Priority Data

Dec. 23, 2016 (EP) ..... 16206786

(51) Int. Cl.

| | |
|---|---|
| ***C10G 21/02*** | (2006.01) |
| ***C10G 21/04*** | (2006.01) |
| ***C10G 21/16*** | (2006.01) |
| ***C10G 21/28*** | (2006.01) |
| ***C10G 61/04*** | (2006.01) |

(52) U.S. Cl.
CPC ..... *C10G 21/02* (2013.01); *C10G 21/16* (2013.01); *C10G 21/28* (2013.01); *C10G 61/04* (2013.01); *C10G 2300/304* (2013.01)

(58) Field of Classification Search
None
See application file for complete search history.

(56) References Cited

U.S. PATENT DOCUMENTS

| | | | |
|---|---|---|---|
| 1,978,010 | A | 10/1934 | Carlisle |
| 1,981,758 | A | 11/1934 | Hans |
| 2,036,966 | A | 4/1936 | Jones |
| 2,293,162 | A | 8/1942 | Montgomery et al. |
| 3,654,128 | A | 4/1972 | Woodle |
| 3,660,273 | A | 5/1972 | Cummins |
| 3,670,888 | A | 6/1972 | Boroughs et al. |
| 3,901,789 | A | 8/1975 | Michael et al. |
| 4,096,168 | A | 6/1978 | Hallgren |
| 4,343,692 | A | 8/1982 | Winquist |
| 4,574,043 | A | 3/1986 | Chester et al. |
| 4,820,400 | A | 4/1989 | Ryan et al. |
| 4,859,311 | A | 8/1989 | Miller |
| 4,892,822 | A | 1/1990 | Abramowicz et al. |
| 4,911,821 | A | 3/1990 | Katzer et al. |
| 4,919,788 | A | 4/1990 | Chen et al. |
| 5,053,373 | A | 10/1991 | Zones |
| 5,157,191 | A | 10/1992 | Bowes et al. |
| 5,252,527 | A | 10/1993 | Zones |
| 5,354,923 | A | 10/1994 | Schoen et al. |
| 5,589,564 | A | 12/1996 | Komiya et al. |
| 5,885,438 | A | 3/1999 | Apelian et al. |
| 7,674,363 | B2 | 3/2010 | Adams et al. |
| 7,763,745 | B2 | 7/2010 | Van Der Heide et al. |
| 8,685,231 | B2 | 4/2014 | Van De Graaf et al. |
| 2004/0152861 | A1 | 8/2004 | Nefzger et al. |
| 2010/0236990 | A1 | 9/2010 | Gleeson et al. |
| 2011/0083995 | A1 | 4/2011 | Gleeson et al. |
| 2015/0203769 | A1 | 7/2015 | Kieffer et al. |

FOREIGN PATENT DOCUMENTS

| | | | |
|---|---|---|---|
| EP | 0532118 | A1 | 3/1993 |
| EP | 0666894 | A1 | 8/1995 |
| EP | 0776959 | A2 | 6/1997 |
| EP | 3807656 | A1 | 11/1997 |
| EP | 0832171 | B1 | 1/2000 |
| EP | 1134248 | A1 | 9/2001 |
| EP | 1548088 | A1 | 6/2005 |
| EP | 2341122 | A1 | 7/2011 |
| GB | 509181 | A | 7/1939 |

(Continued)

OTHER PUBLICATIONS

International Search Report and Written Opinion received for PCT Patent Application No. PCT/EP2017/084105 dated Feb. 19, 2018, 11 pages.

Sequeira, Lubricant Base Oil and Wax Processing, Chapter 7, 1994, pp. 153-193.

International Search Report and Written Opinion received for PCT Patent Application No. PCT/EP2017/084089 dated Feb. 19, 2018, 10 pages.

International Search Report and Written Opinion received for PCT Patent Application No. PCT/US2016/067672, dated Mar. 28, 2017, 8 pages.

International Search Report and Written Opinion received for PCT Patent Application No. PCT/US2016/067664, dated Mar. 29, 2017, 10 pages.

(Continued)

*Primary Examiner* — Tam M Nguyen
(74) *Attorney, Agent, or Firm* — Shell Oil Company

(57) ABSTRACT

The present invention relates to a method for reducing the cloud point of a base oil with high saturates/paraffinic content to below 0° C., wherein the method comprises subjecting said base oils to a cloud point reduction step comprising adding said base oil to a solvent mixture, wherein the solvent mixture comprises a paraffin naphtha fraction and a co-solvent to obtain a solvent treatment mixture; and subjecting the solvent treatment mixture to a solvent de-waxing step.

7 Claims, No Drawings

(56) References Cited

FOREIGN PATENT DOCUMENTS

| | | | |
|---|---|---|---|
| GB | 1154069 | A | 6/1969 |
| JP | S6416826 | A | 1/1989 |
| WO | 9718278 | A1 | 5/1997 |
| WO | 0014179 | A1 | 3/2000 |
| WO | 0029511 | A1 | 5/2000 |
| WO | 1029029 | A1 | 8/2000 |
| WO | 02070627 | A2 | 9/2002 |
| WO | 03070857 | A1 | 8/2003 |
| WO | 2005047439 | A2 | 5/2005 |
| WO | 2006040319 | A1 | 4/2006 |
| WO | 2006040328 | A1 | 4/2006 |
| WO | 2007009975 | A1 | 1/2007 |
| WO | 2009080681 | A2 | 7/2009 |
| WO | 2013150114 | A2 | 10/2013 |
| WO | 2014001546 | A1 | 1/2014 |
| WO | 2014189879 | A1 | 11/2014 |
| WO | 2016107912 | A1 | 7/2016 |

OTHER PUBLICATIONS

International Search Report and Written Opinion received for PCT Patent Application No. PCT/US2016/067666, dated Mar. 28, 2017, 8 pages.

International Search Report and Written Opinion received for PCT Patent Application No. PCT/US2016/067659, dated Mar. 21, 2017, 10 pages.

International Search Report and Written Opinion received for PCT Patent Application No. PCT/EP2016/082570, dated Feb. 13, 2017, 9 pages.

International Search Report and Written Opinion received for PCT Patent Application No. PCT/EP2016/082589, dated Feb. 6, 2017, 9 pages.

Zeng et al., "University Chemistry for Engineering Courses (second edition)", Jun. 30, 1995, pp. 267-268.

Anonymous: "Oil Viscosity Explained", Apr. 29, 2015, XP055664125, Retrieved from the Internet: URL:https://web.archive.org/web/20150429073921/https://www.kewengineering.co.uk/Auto_oils/oil_viscosity_explained.htm.

Makela et al., "Automating the NMR Analysis of Base Oils: Finding Napthene Signals", Fuel, Sep. 2013, vol. 111, pp. 543-554.

Sarpal et al., "Hydrocarbon Characterization of Hydrocracked Base Stocks by One- and Two-Dimensional NMR Spectroscopy", Fuel, Mar. 1996, vol. 75, Issue No. 4, pp. 483-490.

Scherzer et al., "Reactions and Reaction Pathways", Hydrocracking Science and Technology, 1996, Chapter 6, 25 pages.

Office Action Received for Application No. 2016800758793.3, dated Dec. 2, 2019, 9 pages (7 pages of English Translation and 2 pages of Official Copy).

Zeolyst: "About Zeolyst Our Products Inv. Bela", Zeolyst Webpage, Jul. 9, 2015, XP055292507.

Fyfe et al., "Correlations Between Lattice Structures of Zeoliles and their 29Si MAS NMR Spectra: Zeolites Kz-2, SM-12, and Bela", Zeolites, vol. 8, Mar. 31, 1988, pp. 132-136, XP055293684.

Wang et al., "Dealumination of Organic Structure-directing Agent (Usda) Free Beta Zeolite for Enhancing Its Catalytic Performance in N-hexane Cracking", Microporous and Mesoporous Materials, vol. 220, Sep. 15, 2015, pp. 275-281, XP029315079.

Costa et al., "Structural Analysis of Zeolite Beta through Periodic ab Initio simulations of Xrd and 29Si and 170 NMR Spectra", Journal of Molecular Structure, vol. 1097, May 14, 2015, pp. 112-116, XP029189070.

Perez-Pariente et al., "29Si and 27A1 MAS NMR Study of Zeolite beta with Different Si/A 1 Ratios", Journal of Catalysis, vol. 124, 1990, pp. 217-223, XP055292579.

Kunkeler et al., "Zeolite Beta: The Relationship between Calcination Procedure, Aluminum Configuration, and Lewis Acidity", Journal of Catalysis, vol. 180, Issue No. 2, Dec. 10, 1998, pp. 234-244, XP004447229.

Kadgaonkar et al., "Synthesis and Characterization of NCL-5, NCL-6 and NCL-7: New Zeolites Enriched With Polymorph B of the BEA Family", Microporous and Mesoporous Material, vol. 105, Issue No. 1-2, Sep. 7, 2007 pp. 82-88, XP022235370.

HAZE-FREE BASE OILS WITH HIGH PARAFFINIC CONTENT

CROSS REFERENCE TO EARLIER APPLICATION

The present application is the National Stage (§ 371) of International Application No. PCT/EP2017/084105, filed Dec. 21, 2017, which claims priority from EP Application 16206786.2, filed Dec. 23, 2016 incorporated herein by reference.

FIELD OF THE INVENTION

The present invention relates to a method for reducing the cloud point of base oils with high paraffinic content.

BACKGROUND OF THE INVENTION

A commonly accepted way of categorising base oils is provided by The American Petroleum Institute (API), according to which, base oils are categorised into five groups according to their sulphur content, saturates/paraffinic content, as well as according to their viscosity index. Group I base oils comprise more than 0.03% sulphur, less than 90% saturates/paraffinic content, and have a viscosity index ranging between 80 to 120. Group II base oils, in contrast, comprise less than 0.03% sulphur, more than 90% saturates/paraffinic content, and have a viscosity index ranging between 80 to 120. Group III base oils, on the other hand, have a viscosity index above 120, even though their sulphur saturates/paraffinic contents are in the same range as Group II base oils. A further difference between Group I, Group II and Group III base oils is that, Group I base oils are solvent refined, Group II base oils are hydro-treated and Group III base oils are hydro-cracked, said two processes leading to the increased saturates/paraffinic content of Group III over Group I and Group II, and Group II over Group I. Group IV base oils are polyalphaolefins, and Group V includes all base oils that do not fall within Groups I to IV.

Base oils can suffer from the undesirable presence of a waxy haze. Such waxy haze is attributed often to the presence of long carbon chain paraffins, and their presence adversely affect the intended lubrication function of base oils, for example by changing their viscosity or by clogging up hardware components.

The waxy haze may be inferred or measured in a number of ways, for instance by according to the standard test method 'ASTM D4176-04'. Whilst initially ASTM D4176-04 was set up for fuels, it is also a relevant standard test method that can be adopted for base oils, by providing a numerical rating of haze appearance. Samples that pass the ASTM D4176-04 test conform to the so-called 'clear and bright' standard.

To conform to the 'clear and bright' standard, hazy base oils need to have their cloud point reduced by a process of de-waxing.

De-waxing may be carried out by treating hazy base oils with one or more solvents, or by subjecting the hazy base oils to a chemical process where insufficiently isomerized long carbon chain paraffins that contribute to the haze are catalytically isomerized/cracked to convert them into molecules that do not attribute to any haze.

Solvent de-waxing has an advantage over catalytic de-waxing in that it is less complicated to carry out, for which less costly hardware maybe used.

WO02070627 and WO2009080681 describe exemplary processes for solvent and catalytic de-waxing.

Solvent dewaxing is well known to those skilled in the art and involves admixture of one or more solvents and/or wax precipitating agents with a base oil or a base oil precursor fraction, and cooling the mixture to a temperature in the range of from −10° C. to −40° C., preferably in the range of from −20° C. to −35° C., to separate the wax from the oil. The base oil containing the wax is then usually taken through a physical separation step, such as filtration or centrifugation, to remove the precipitated wax crystals from the base oil or the base oil precursor fraction. As a final step, the admixture can be removed from the base oil by a process such as distillation.

Examples of solvents which may be employed in the solvent dewaxing process are $C_3$-$C_6$ ketones (e.g. methyl ethyl ketone (MEK), methyl isobutyl ketone and mixtures thereof), $C_6$-$C_{10}$ aromatic hydrocarbons (e.g. toluene), mixtures of ketones and aromatics (e.g. MEK and toluene), autorefrigerative solvents such as liquefied, normally gaseous $C_2$-$C_4$ hydrocarbons such as propane, propylene, butane, butylene and mixtures thereof. Mixtures of MEK and toluene, or MEK and methyl isobutyl ketone are generally preferred. Mixture of MEK and toluene is the most preferred. Examples of these and other suitable solvent dewaxing processes are described in "Lubricant Base Oil and Wax Processing", Avilino Sequeira, Jr, Marcel Dekker Inc., New York, 1994, Chapter 7.

Without being bound to any one theory, for example where an MEK-toluene mixture is used, MEK is thought to induce wax crystal formation, and toluene is thought to reduce the viscosity of the solvent-base oil mixture, so that wax crystals may be removed by processes such as filtration or by centrifugation, which are carried out at temperatures below the cloud point of the solvent-base oil mixture. However, toluene and other aromatic hydrocarbons are begin to be substantially insoluble in base oils with higher saturates/paraffinic content. Consequently, adequate solvent dewaxing of base oils becomes harder to achieve with higher saturates/paraffinic content using MEK-toluene.

It is therefore an object of the present invention to provide a method for reducing the cloud point of base oils with high saturates/paraffinic content to below 0° C. It is a further objective of the present invention to provide a method for the preparation of base oils with high saturates/paraffinic content that remain 'clear and bright' at 0° C.

SUMMARY OF THE INVENTION

Accordingly, the present invention provides a method for reducing the cloud point of a base oil with high saturates/paraffinic content to below 0° C., wherein the method comprises subjecting said base oils to a cloud point reduction step comprising adding said base oil to a solvent mixture, wherein the solvent mixture comprises a paraffinic naphtha fraction and a co-solvent to obtain a solvent treatment mixture; and subjecting the solvent treatment mixture to a solvent de-waxing step.

The inventors of the present method have surprisingly discovered that the solvent mixture comprising a paraffinic naphtha fraction and a co-solvent is soluble in base oils with high saturates/paraffinic content, and thereby enables their respective cloud points to be reduced below 0° C.

DETAILED DESCRIPTION OF THE INVENTION

The present invention concerns a method for reducing the cloud point of a base oils with high saturates/paraffinic content to below 0° C., wherein the method comprises subjecting said base oils to a cloud point reduction step comprising (a) adding said base oils to a solvent mixture, wherein the solvent mixture comprises a paraffinic naphtha fraction and a co-solvent to obtain a solvent treatment mixture; and (b) subjecting the solvent treatment mixture to a solvent de-waxing step.

With respect to the present invention, base oils with high saturates/paraffinic content may be base oils with more than 90% saturates/paraffinic content, such as Group II and Group III base oils (according to the API categories). Suitably, base oils with high saturates/paraffinic content may be also base oils with more than 95% saturates/paraffinic content. Suitably, base oils with high saturates/paraffinic content may be also base oils with 98% or more saturates/paraffinic content.

As used herein, references to "paraffinic(s)" refer to alkanes, and references to "saturates" refer to carbon compounds devoid of double and triple carbon-carbon bonds. Preferably, the base oil comprises more than 90 wt. % of paraffins and more than 90 wt. % of saturates.

As discussed earlier, at ambient temperature, and particularly at 0° C. and below, base oils with high saturates/paraffinic content can suffer from the undesirable presence of a waxy haze, and the inventors of the present method surprisingly discovered that the cloud point of base oils with high saturates/paraffinic content can be reduced to below 0° C. using a naphtha fraction. Suitably, the naphtha fraction is a Fischer-Tropsch process derived paraffinic fraction.

It is known in the art that the Fischer-Tropsch process enables the manufacture of paraffinic molecules from gaseous hydrocarbon feedstock by first breaking down the hydrocarbon feedstock to carbon monoxide and hydrogen, then by building them up to larger paraffinic molecules, followed by subjecting the larger paraffinic molecules to hydroisomerization/hydrocracking whereby long chain normal-paraffins and slightly branched paraffins are removed and/or rearranged/isomerized into more heavily branched iso-paraffins.

It is also known in the art that the more heavily branched iso-paraffins may be fractionated, such as by atmospheric distillation, to commercially useful fractions such as kerosene and diesel.

The inventors of the present method surprisingly discovered that the naphtha fraction may be obtained from said atmospheric distillation, which is conventionally used to fractionate the more heavily branched iso-paraffins into, for example, kerosene and diesel.

Suitably, the naphtha fraction that may be obtained from said atmospheric distillation comprises paraffinic molecules with boiling points less than 200° C. at ambient atmospheric pressure. Preferably, the lower boiling point fraction comprises paraffinic molecules with boiling points between 35° C. and 200° C., more preferably boiling points between 40° C. and 200° C., and even more preferably boiling points between 70° C. and 170° C., all boiling points being at around ambient atmospheric pressure. Preferably, the paraffinic naphtha fraction according to the present invention comprises less than 5 wt. % of aromatics and a content of paraffins of more than 90 wt. % according to ASTM D6839. More preferably, the paraffinic fraction comprises at least 90 wt. % paraffins, at most 5 wt. % aromatics and at most 1 wt. % olefins. Even more preferably, the paraffinic naphtha fraction comprises n-paraffins in a range of from 40 to 50 wt. %, iso-paraffins in a range of from 50 to 60 wt. %, naphthenes in a range of from 2 to 3 wt. % and aromatics in a range of from 0 to 0.1 wt. %.

Suitably, the naphtha fraction comprises paraffinic molecules comprising carbon chain length of up to 11.

Preferably, the naphtha fraction comprises paraffinic molecules comprising carbon chain length in the range of from 5 to 11, more preferably the naphtha fraction comprises paraffinic molecules comprising carbon chain lengths of from 6 to 10, even more preferably the naphtha fraction comprises paraffinic molecules comprising carbon chain lengths of from 6 to 9, and most preferably the naphtha fraction comprises paraffinic molecules comprising carbon chain lengths of from 6 to 8. Optionally, naphtha fraction may be a paraffinic molecule of carbon chain length of 7, such as heptane.

Further, suitably, the naphtha fraction comprises paraffinic molecules of carbon chain length of 6, 7 and 8.

Suitably, the naphtha fraction comprises paraffinic molecules of carbon chain length of either 5, or 6, or 7, or 8, or 9, or 10, or 11.

Suitably, the naphtha fraction comprises a mixture of any combination thereof of paraffinic molecules of carbon chain length of either 5, or 6, or 7, or 8, or 9, or 10, or 11.

Examples of the naphtha fraction a mixture of any combination thereof of paraffinic molecules of carbon chain length of either 5, or 6, or 7, or 8, or 9, or 10, or 11, may be for example, a paraffinic molecule of carbon chain length of 5 in a mixture comprising at least a paraffinic molecule of carbon chain length of 6, or 7, or 8, or 9, or 10, or 11; or paraffinic molecules of carbon chain length of 6 in a mixture comprising at least a paraffinic molecule of carbon chain length of 5, or 7, or 8, or 9, or 10, or 11; or paraffinic molecules of carbon chain length of 7 in a mixture comprising at least a paraffinic molecule of carbon chain length of 5, or 6, or 8, or 9, or 10, or 11; or paraffinic molecules of carbon chain length of 8 in a mixture comprising at least a paraffinic molecule of carbon chain length of 5, or 6, or 7, or 9, or 10, or 11; or paraffinic molecules of carbon chain length of 9 in a mixture comprising at least a paraffinic molecule of carbon chain length of 5, or 6, or 7, or 8, or 10, or 11; or paraffinic molecules of carbon chain length of 10 in a mixture comprising at least a paraffinic molecule of carbon chain length of 5, or 6, or 7, or 8, or 9, or 11; or paraffinic molecules of carbon chain length of 11 in a mixture comprising at least a paraffinic molecule of carbon chain length of 5, or 6, or 7, or 8, or 9, or 10.

In the method of the present invention, the cloud point of the base oil with high saturates/paraffinic content is reduced to below 0° C.

The method of the present invention comprises the steps of subjecting the base oil with high saturates/paraffinic content to a cloud point reduction step comprising mixing the base oil with high saturates/paraffinic content with a solvent mixture, wherein the solvent mixture comprises a naphtha fraction and a co-solvent, and subjecting the solvent treatment mixture to a solvent de-waxing step.

Suitably, the co-solvent is methyl ethyl ketone. Suitably the co-solvent may also be methyl isobutyl ketone or methyl butyl ketone or methyl propyl ketone or methyl isopropyl ketone.

In the method of the present invention, suitably the weight ratio of the naphtha fraction to the co-solvent in the solvent mixture is in the range of from 70:30 wt % to 30:70 wt % respectively. Preferably, the weight ratio of the naphtha fraction to the co-solvent in the solvent mixture may be in the range of from 60:40 wt % to 40:60 wt % respectively, and more preferably, the weight ratio of the naphtha fraction to the co-solvent in the solvent mixture may be 50:50 wt % respectively.

In the method of the present invention, suitably the base oil with high saturates/paraffinic content is mixed with the solvent mixture in the weight ratio range of from 1:3 to 1:6 respectively at a temperature in the range of from 20° C. to 150° C. to provide a solvent treatment mixture.

Preferably, the weight ratio in which the base oil with high saturates/paraffinic content is mixed with the solvent mixture is 1:4 respectively.

Suitably, the temperature at which the base oil with high saturates/paraffinic content is mixed with the solvent mixture may be in the range of from 30° C. to 150° C.

Suitably, the temperature at which the base oil with high saturates/paraffinic content is mixed with the solvent mixture may be also in the range of from 40° C. to 120° C.

Following the mixing of the base oil with high saturates/paraffinic content with the solvent mixture, suitably the solvent treatment mixture is cooled to below at least 0° C. to obtain a mixture comprising a wax fraction and a de-waxed fraction, wherein the de-waxed fraction comprises the base oil with high saturates/paraffinic content and the solvent mixture. Preferably, the solvent treatment mixture is cooled to below −20° C. to enable the formation, and removal, of wax crystals.

Preferably, the solvent treatment mixture is cooled to below −20° C. to enable the formation, and removal, of wax crystals.

The wax crystals are removed from the solvent treatment mixture by subjecting the solvent treatment mixture to a mechanical treatment known in the art, such as by the use of a spinning drum to undertake a filtration process.

Once the wax crystals are removed from the solvent treatment mixture, a de-waxed fraction remains, comprising the base oil with high saturates/paraffinic content and the solvent mixture.

Suitably, the solvent mixture is removed from the de-waxed fraction by a distillation step to obtain a base oil with high saturates/paraffinic content with a cloud point below 0° C.

That which is claimed is:

1. A method for reducing the cloud point of a base oil comprising a high saturates and paraffinic content to below 0° C., the method comprising:

(a) combining the base oil with a solvent and a co-solvent to form a treatment mixture, wherein the solvent comprises a paraffinic naphtha fraction, and wherein the co-solvent comprises one or more of methyl isobutyl ketone, methyl butyl ketone, methyl propyl ketone, and methyl isopropyl ketone; and (b) cooling the treatment mixture to a temperature of less than −20° C. to form a wax crystal and a de-waxed mixture comprising a portion of the solvent and a de-waxed oil;

(c) separating the wax crystal from the de-waxed mixture to form a separated de-waxed mixture comprising the portion of the solvent and the de-waxed oil;

(d) distilling the separated de-waxed mixture to form a distilled solvent and a de-waxed oil, wherein the de-waxed oil comprises a cloud point below 0° C.

2. The method according to claim 1, wherein the paraffinic naphtha fraction comprises paraffinic molecules comprising carbon chain lengths in the range of from 5 to 11.

3. The method according to claim 1, wherein the paraffinic naphtha fraction comprises paraffinic molecules of at least one of carbon chain length 6, 7 and 8.

4. The method according to claim 1, wherein the paraffinic naphtha fraction comprises paraffinic molecules of carbon chain length comprising one or more of 5, 6, 7, 8, 9, 10, and 11.

5. The method according to claim 1, wherein the co-solvent further comprises methyl ethyl ketone.

6. The method according to claim 1, wherein the weight ratio of the naphtha fraction to the co-solvent is from 70:30 to 30:70.

7. The method according to claim 1, wherein the combining the base oil with the solvent is done at a ratio of base oil to solvent of from 1:3 to 1:6, and wherein the combining the base oil with the solvent is done at a temperature from 20° C. to 150° C.

* * * * *